United States Patent [19]

Farnworth

[11] Patent Number: 4,558,896

[45] Date of Patent: Dec. 17, 1985

[54] HANDLE

[76] Inventor: David J. Farnworth, 11 Kemsley Rd., Felixstowe, Suffolk, England

[21] Appl. No.: 560,804

[22] Filed: Dec. 13, 1983

[30] Foreign Application Priority Data

Dec. 15, 1982 [GB] United Kingdom ..... 8235655
Aug. 9, 1983 [GB] United Kingdom ..... 8321378

[51] Int. Cl.[4] ..... A45C 13/26; B65D 71/00

[52] U.S. Cl. ..... 294/156; 294/153; 294/167

[58] Field of Search ..... 294/27 R, 27 H, 31.2, 294/74, 137, 141–143, 146–157, 167, 170; 24/16 PB, 17 A, 17 B, 17 AP, 30.5 P, 30.5 S; 383/13, 24; 280/814

[56] References Cited

U.S. PATENT DOCUMENTS

| | | | |
|---|---|---|---|
| 1,146,334 | 7/1915 | Lehman et al. | 294/31.2 |
| 1,539,201 | 5/1925 | Ottow | 294/31.2 |
| 3,072,986 | 1/1963 | Lefnaer | 24/16 PB |
| 3,584,772 | 6/1971 | Robertson | 294/142 |
| 3,692,218 | 9/1972 | Friedman | 294/167 X |
| 3,709,544 | 1/1973 | Oltmanns | 294/31.2 |
| 3,958,731 | 5/1976 | Riedle | 294/152 |
| 3,976,234 | 8/1976 | Moudry et al. | 280/814 |
| 4,284,219 | 8/1981 | Standel | 294/152 |

*Primary Examiner*—Johnny D. Cherry
*Attorney, Agent, or Firm*—Ladas & Parry

[57] ABSTRACT

A handle for carrying loads has a grip and a strap extending from the grip. The grip is formed so that it is comfortable to hold. The free end of the strap has a bar which can be engaged in a slot so as to form the strap into a closed loop. In use, the strap is passed through a convenient part of the load before the bar at the end of the strap and the slot are engaged. When the grip is lifted to lift the load, the weight of the load and the configuration of the slot will keep the end of the strap engaged so that the load can be carried securely and comfortably.

5 Claims, 4 Drawing Figures

HANDLE

FIELD OF THE INVENTION

This invention relates to a handle which can be attached to a load to facilitate carrying of the load.

Many loads have to be carried by hand, yet are not provided with handles, or only with inadequate handles. Tins of paint with wire handles, or plastics carrier bags are examples. When these loads are heavy, the handles bite into the hands and become uncomfortable and difficult to carry.

PRIOR ART

A handle of this type is known from U.S. Pat. No. 3 493 154. This handle is made from a flat sheet of material and is attached to a load by passing one end of the strap through a slot in the other end. This handle is really only suitable for use with loads within a particular size range, since it is the size of the load itself which determines the length of the loop formed in the strap and surrounding the load. If the strap is looped through the handles of carrier bags, the loop will become very small, and the grip will be a long way above the load, making the load difficult to carry. As a result of the construction of the strap from a single sheet of material, the grip will not be very comfortable to hold. Furthermore, the slot through which the smaller end of the strap is passed will not be very strong and with heavy loads, the long sides of the slot will be pulled apart, placing a considerable load on the material around the ends of the slot, which could easily fail.

Another handle of this type is known from U.S. Pat. No. 4 284 219. With this handle, the user always has to hold two ends in his hand, and this is more difficult than having to hold a single end. One end could be accidentally dropped, releasing the articles being carried. Two hands may be necessary to place the two ends together, before the handle and load can be carried. FIG. 11 of this specification does show a form of handle where a single grip is used, but there is no indication of how any more than marginal strength can be given to the connection between the grip and the strap end.

U.S. Pat. No. 3 958 731 shows another handle of the type in question. This specification does suggest that the free end of the strap could be attached back to the handle, below the grip, but there is no indication of how sufficient strength can be imparted to this connection to enable the strap to be used for carrying a variety of heavy loads of differing forms.

SUMMARY OF THE INVENTION

According to the invention, there is provided a handle having a grip portion and a strap portion, the strap portion having a free end with a terminal enlargement, and another part of the handle having a slot so that when the strap portion is turned back on itself, the free end can be detachably connected to said another part of the handle to form a loop, the free end being placed through the slot so that the terminal enlargement engages behind the slot.

Such a handle can be used to supplement an existing, uncomfortable handle on a load, or can provide a handle for a load which previously did not have a handle at all.

Preferably the grip portion (hereinafter referred to as the grip) is at right angles to the plane of the loop formed when the strap portion (hereinafter referred to as the strap) is bent back on itself. The grip will thus, in use, be parallel to the part of a load to which the strap is attached.

The handle is preferably made in one piece. Conveniently it can be a single plastics moulding, with the material thickness of the grip being thicker than the material thickness of the strap, for ergonomic reasons.

If the grip includes an opening through which the carrier's fingers project, the slot may extend from that opening. It is advantageous if the slot has angled sides, with the wider part of the slot at the bottom. This helps to prevent accidental release of the free end of the strap.

The strap may have a central region wider than its two ends. This will spread the weight of the load over a wide area of the load. If the wide central region also includes an elongate slot extending in the direction of the length of the strap, the parts of the strap on either side of the slot will tend to approach one another when under load so that the strap takes up a curved configuration where the load passes over it. This again helps to spread the weight of the load over a wide area of the load and also reduces the risk of damage to the load which might be caused by the edges of the strap biting into the load.

BRIEF DESCRIPTION OF THE DRAWINGS

The invention will now be further described, by way of example, with reference to the accompanying drawings, in which.

The handle shown has a grip 10 and a strap 12. The strap and grip are both made in one piece, and meet each other in an area 14. The handle can be injection moulded in a suitable plastics such as polyethylene or polypropylene.

Figure 1:
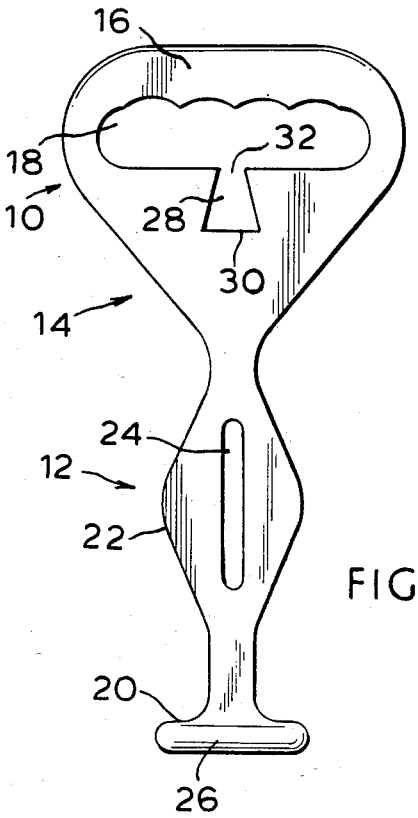
FIG. 1 is a front view of a handle according to the invention.
Figure 2:
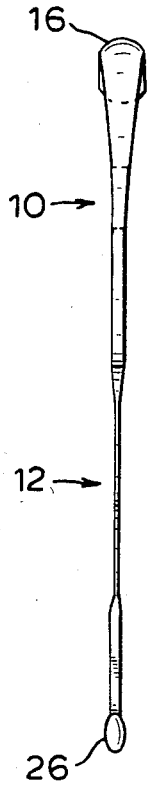
FIG. 2 is a side view of the handle shown in FIG. 1.
Figure 3:
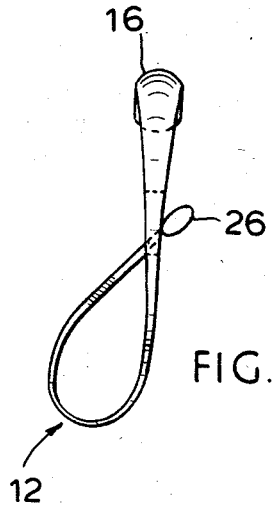
FIG. 3 is another side view showing the strap turned back on itself to form a loop.

The grip has an upper bar 16 which is somewhat thicker than the rest of the handle, as can be seen in FIGS. 2 and 3, to make it comfortable to hold. The fingers are inserted through a hole 18 and grip around the upper bar which is shaped to locate convenient positions for four fingers. The strap 12 can be made as thin as is consistent with the weight to be lifted, in order to avoid excessive use of material.

The strap 12 has a free end 20 remote from the area 14, and a central region 22. The central region 22 is wider than either end of the strap and has a slot 24 formed in it. As shown in FIG. 2, the central region 22 has a reduced thickness from that of the rest of the strap to facilitate bending and twisting of the strap as discussed below. At the free end 20, a T-bar 26 is formed. This may be thicker than the rest of the strap, to make it stronger against bending.

Below the upper bar 16 of the grip, a slot 28 is formed. The base 30 of this slot is wider than the free end of the strap above the T-bar, but the opening 32 of the slot is narrower than the strap.

In use, the free end 20 of the strap is passed around a load to be carried or through a convenient opening in the load. The strap is then turned back on itself, and the free end is engaged in the slot 28. To do this, because of the relative dimensions of the slot opening and the strap, it is necessary to twist the end of the strap so that it enters the slot with one edge leading. Once through the opening, the strap will untwist to the position shown in FIG. 4 and will not be able to come out of the slot unless it is first twisted again.

Figure 4:
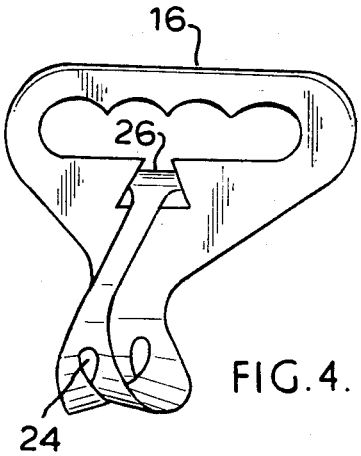
FIG. 4 is a perspective view of the handle in use.

The load can then be lifted. As can be seen in FIG. 4, the parts of the central region 22 on either side of the slot 24 will move towards each other and provide a curved surface to come in contact with the load. There will then be no hard edges of the strap cutting into the load. The provision of the slot 24 also helps to reduce the amount of material needed to form the handle.

As can be seen in FIG. 2, the handle has a median plane lying intermediate opposed faces of the strap 12 and the handle is symmetrical on either side of said median plane. This insures that any loads being lifted are brought back to the median plane of the handle increasing the strength of the handle.

The terminal enlargement formed by the T-bar, and its engagement behind the slot 28 gives a very strong connection. Tests have shown that a weight of over 100 pounds can be lifted with a handle as shown, made from a low-density polyethylene, with no damage to the handle, although a lower safe working load of 50 pounds has been set. Specification of a high-density polyethylene would obviously increase the weight that can be carried, and a handle made from high-density polyethylene has supported a weight of 170 pounds without any damage and without any disconnection between the T-bar 26 and the slot 28.

The fact that the strap forms a closed loop in use is also important, because it will help to keep a bag closed, or help to keep a bundle together. In fact, the handle can provide a dual function in relation to a coil of e.g. hosepipe or electric cable in holding the coil together and giving the coil a handle by which it can be carried or hung on a hook.

The strap can clearly be of any suitable length, depending on the application for which it is intended. The grip portion does not have to be the shape shown in the drawing; instead a T-bar or other shape could be adopted.

I claim:

1. A handle having a grip portion and a single elongate strap portion which has a longitudinal axis and is connected to the grip portion so that said axis extends through the center of the grip portion, with the grip and strap portions being formed in a single piece of bendable and twistable material, and the handle having a median plane containing the longitudinal axis and lying intermediate the faces of the strap portion, the handle being symmetrical on either side of said median plane, the strap portion having a free end with a terminal enlargement in the form of a T-bar at right angles to said axis, and another part of the handle, between the grip portion and the terminal enlargement having a slot which has angled sides with the wider part of the slot at the bottom and the narrower part at the top whilst the width of the strap portion adjacent the T-bar is greater than the width of the narrower part of the slot, but less than the width of the wider part of the slot, so that when the strap portion is turned back on itself, the free end can be detachably connected to said another part of the handle to form a loop, the free end being placed through the slot so that the T-bar engages behind the slot.

2. A handle as claimed in claim 1, wherein the grip portion is arranged at right angles to the plane of the loop which will be formed, in use, when the strap portion is turned back on itself.

3. A handle as claimed in claim 1, wherein the grip portion includes an opening through which the carrier's fingers can project, and the slot extends from that opening.

4. A handle as claimed in claim 1, wherein the strap portion has a central region between two end regions, with the central region being wider than the two end regions and thinner than the two end regions.

5. A handle as claimed in claim 4, wherein the wider and thinner central region includes an elongate slot extending in the direction of the length of the strap portion.

* * * * *